US005453351A

United States Patent [19]

Ueda et al.

[11] Patent Number: 5,453,351

[45] Date of Patent: Sep. 26, 1995

[54] SILVER HALIDE PHOTOGRAPHIC LIGHT-SENSITIVE MATERIAL

[75] Inventors: Eiichi Ueda; Masahito Takada, both of Tokyo, Japan

[73] Assignee: Konica Corporation, Tokyo, Japan

[21] Appl. No.: 296,656

[22] Filed: Aug. 26, 1994

[30] Foreign Application Priority Data

Aug. 30, 1993 [JP] Japan ..... 5-214283

[51] Int. Cl.[6] ..... G03C 1/76

[52] U.S. Cl. ..... 430/532; 430/538; 430/935; 430/942; 430/523; 430/631; 430/536; 430/930

[58] Field of Search ..... 430/532, 538, 430/935, 942, 523, 631, 536, 930

[56] References Cited

U.S. PATENT DOCUMENTS

| | | | |
|---|---|---|---|
| 4,364,971 | 12/1982 | Sack | 430/538 |
| 4,384,040 | 5/1983 | von Meer | 430/532 |
| 4,729,945 | 3/1988 | Anthonsen et al. | 430/532 |
| 4,755,454 | 7/1988 | Aotsuka et al. | 430/538 |
| 5,070,006 | 12/1991 | Krafft et al. | 430/930 |
| 5,084,344 | 1/1992 | Harada et al. | 430/538 |
| 5,290,668 | 3/1994 | Ohtani | 430/496 |
| 5,312,682 | 5/1994 | Nishikawa et al. | 430/538 |

FOREIGN PATENT DOCUMENTS 0049946 3/1982 Japan .

*Primary Examiner*—Thomas R. Neville

*Attorney, Agent, or Firm*—Frishauf, Holtz, Goodman, Langer & Chick

[57] ABSTRACT

A silver halide photographic light-sensitive material is disclosed. The light-sensitive material comprises a support comprising a substrate and an electron beam-cured resin layer provided on a surface of the substrate, and a hydrophilic colloid layer provided on said resin layer. The resin layer comprises an electron beam-curable composition cured by electron beam radiation and a white pigment in an amount of 20% to 70% by weight. The hydrophilic colloid layer includes at least one silver halide emulsion layer and optionally a non-light-sensitive hydrophilic colloid layer, and contains gelatin and an oil component. In the light-sensitive material, the curling degree of the support R $m^{-1}$, the coating amount of the gelatin G $g/m^2$, and the coating amount of the oil component Oi $g/m^2$ are each $-8 \leqq R \leqq -1$, $2 \leqq G \leqq 20$ and $0 \leqq Oi \leqq 20$, respectively, and a value Y calculated by the following equation is $-3 \leqq Y \leqq 5$;

$$Y=0.9G-0.40i+R \quad \text{Equation}$$

6 Claims, No Drawings

SILVER HALIDE PHOTOGRAPHIC LIGHT-SENSITIVE MATERIAL

FIELD OF TEE INVENTION

The present invention relates to a silver halide photographic light-sensitive material, and more particularly to a silver halide photographic light-sensitive material useful as a photographic printing paper and having a hardened overcoat layer formed by electron beam curing treatment.

BACKGROUND OF TEE INVENTION

There have conventionally been photographic printing paper products manufactured by coating photographic layers on a polyolefin resin-laminated paper support; paper supports of this kind have often been used in recent years because they do not allow processing solutions to permeate thereinto and thus they are suitable for speeding up the processing.

The above-mentioned polyolefin resin generally contains an inorganic white pigment such as titanium oxide or calcium carbonate in order to increase not only the whiteness and hiding power of the support but also the resolusion and sharpness of the photographic emulsion layer. However, when the polyolefin resin is moltenly extruded at a high temperature to be laminated on a paper support, if the inorganic pigment content of the resin is excessive, uneven dispersion of the pigment occurs, so that the allowable inorganic pigment content limit is ten-odd per cent at most, and thus it has still not attained technical feasibility for obtaining satisfactory sharpness.

Japanese Patent-Publication Open to Public Inspection (hereinafter abbreviated to JP O.P.I.) Nos. 27257/1982 and 49946/1982 disclose techniques for providing a photographic paper support having thereon a laminated resin layer cured by electron beam irradiation. If such a support is used, the white pigment content of its resin can be increased by 20 to 70% by weight, leading to improving the sharpness to be much better than that in the polyolefin resin lamination.

It has been found, however, that if a photographic paper laminated with such a high-white-pigment-content resin layer is processed in an automatic processor equipped with a conventional cut-transport-type printer, transport trouble can possibly occur depending on the processing condition.

SUMMARY OF TEE INVENTION

It is an object of the invention to provide a photographic printing paper that is excellent in the transportability inside an automatic processor which has a laminated resin layer cured by electron beam radiation.

It has been found by the inventors that when both the curling degree of the support and the composition of the emulsion layer are controlled so as to have a certain relation within a specific range, the above problem does not occur.

The silver halide photographic light-sensitive material of the invention comprises a support comprising a substrate and an electron beam-cured resin layer provided on a surface of the substrate, and a hydrophilic colloid layer provided on said resin layer.

The resin layer comprises an electron beam-curable composition cured by electron beam radiation and a white pigment in an amount of 20% to 70% by weight. The hydrophilic colloid layer includes at least one silver halide emulsion layer and optionally a non-light-sensitive hydrophilic colloid layer, and contains gelatin and an oil component. In the above light-sensitive material, a curling degree of the support R in terms of $m^{-1}$, the coating amount of the gelatin contained in said hydrophilic layer G in terms of $g/m^2$, and the coating amount of the oil component contained in said hydrophilic layer Oi in terms of $g/m^2$ are each $-8 \leqq R \geqq -1$, $2 \geqq G \geqq 20$ and $0 \leqq Oi \leqq 20$, respectively, and a value Y calculated by the following equation is equal to or larger than −3 and equal to or smaller than 5: $-3 \leqq Y \leqq 5$;

$$Y=0.9G-.40i+R \qquad \text{Equation}$$

in the above, R represents a longitudinal curling degree (reciprocal of radius of curvature) of the support when cut and slit into 82 mm×117 mm size piece, the value is positive (+) when the support curls so that the side of the support, on which said hydrophilic layer to be provided, makes a concave.

DETAILED DESCRIPTION OF THE INVENTION

A material used for the substrate of the invention, usually, is paper, particularly one produced from natural pulp, synthetic pulp or a mixture of these pulps; any one of those goodflatness papers such as, for example, photographic paper, woodfree paper, and the like, may be used in the invention.

The paper is of preferably 80 μm to 250 μm in thickness and 80 g to 200 $g/m^2$ in weight.

The paper as the support may, if necessary, contain a paper strength increasing agent, a sizing agent, a coloring agent and a brightening agent. Instead of the paper, there may be used a film such as polyester, polystyrene or cellulose triacetate, which may or may not contain a pigment.

The component of the resin layer in the invention is an electron beam-cured resin layer. The electron beam curing composition comprises an electron beam curing compound and a pigment and, if necessary, other additives.

The electron beam curing compound used in the invention may be any compound curable when subjected to electron beam radiation, such as a compound whose molecular chain contains preferably two or more unsaturated double-bonds which, when subjected to electron beam radiation, generate radicals to exert polymerization or crosslinking reaction to harden; and a cationically polymerizable compound (used with a polymerization initiator) as described in JP O.P.I. No. 147018/1984.

Where paper is used as the substrate, the use of an increased amount of an inorganic pigment tends to cause the hardened coat layer to become brittle. Therefore, in order to avoid such a tendency, the use of the following resins, which do not impair the elasticity peculiar to paper, is suitable.

1) Unsaturated polyesters

The compounds disclosed in Japanese Patent Examined Publication (hereinafter abbreviated to JP E.P.) Nos. 23654/1973, 23293/1974, 47103/1974, 44572/1974 and JP O.P.I.No.7473/1979.

2) Modified unsaturated polyesters

Urethane-modified unsaturated polyesters

Particularly, the compounds disclosed in JP E.P.No.14667/1973.

Acrylurethane-modified unsaturated polyesters

Particularly, the compounds disclosed in JP E.P.No.14790/1973.

Liquid unsaturated polyesters having a terminal acryl group.

Particularly, the compounds disclosed in U.S. Pat. Nos. 3,455,802 and 3,485,732.

3) Acryl polymers

Polyester acrylate compounds

The polyester acrylate oligomers described in A.C.J. Van Oosterhout and A. Van Neerbos, Double Liaison-Chim Peint., 27 (295), 135 (1980).

Epoxy acrylate compounds

The compounds described in JP E.P. No.13023/1972 and JP O.P.I. No.162713/1982; i.e., epoxy acrylate compounds obtained by the addition of acrylic acid and other α, β-unsaturated carboxylic acids to multifunctional epoxy compounds.

Silicone acrylate compounds

The condensation products of hydroxyl or methoxy group-containing silicones with hydroxyethyl methacrylate disclosed in JP E.P. No.22172/1973 and JP O.P.I. No. 39594/1973.

Urethane acrylate compounds

The urethane acrylate compounds disclosed in U.S. Pat. Nos. 3,864,133, 3,891,523 and 3,912,516; JP E.P. Nos. 22172/1973, 35346/1974 and 31239/1977; JP O.P.I. Nos. 39594/1973, 26337/1974, 96043/1974, 80394/1979, 129034/1979 and 127994/1979, the compounds including those obtained by the addition reaction of hydroxyethyl methacrylate to multifunctional isocyanate compounds; those obtained by the reaction of polyoxyalkylenebisphenol A derivatives with polyisocyanates and acrylates containing polyisocyanate and hydroxy group; and amidourethane acrylates obtained by the reaction of hydroxy-multifunctional group-having amido-containing compounds with acrylate compounds containing polyisocyanates and hydroxy group.

4) Butadiene polymer compounds

Modified polybutadienes obtained by the addition of monoester compound and aliphatic lower carboxylic acids to the urethanated 1,2-polybutadiene disclosed in JP O.P.I. No. 123187/1975 or the epoxidated polybutadiene disclosed in JP O.P.I. No. 148094/1979.

Among the above monomers, epoxy acrylates, butadiene or its derivatives and urethane acrylates are preferably used.

The above-mentioned compounds may be used alone or in a mixture of two or more thereof, and their average molecular weight is preferably 500 to 20000, more preferably 1000 to 10000.

It is preferable to use the above compound in the form of a mixture with an unsaturated bonding-having monomer in the compound/monomer mixing ratio by weight of 90/10 to 10/90 in order to adjust the viscosity and curability of the electron beam curing composition and to adjust the physical properties of the cured layer.

Typical examples of the above monomer include:

a) monofunctional monomers such as
methyl acrylate, ethyl acryate, butyl acrylate, 2-ethylhexyl methacrylate, 2-hydroxyethyl acrylate, 2-hydroxyethyl methacrylate, glycidyl methacrylate, hexyl acrylate, lauryl acrylate;

b) bifunctional monomers such as
1,6-hexanediol diacrylate, 1,6-hexanediol dimethacrylate, neopentyl glycol, 1,4-butanediol diacrylate, ethylene-glycol diacrylate, polyethylene-glycol diacrylate, pentaerythritol diacrylate, divinylbenzene; and c) tri- and upward-functional monomers such as
trimethylolpropane triacrylate, trimethylolpropane trimethacrylate, pentaerythritol triacrylate, dipentaerythritol hexaacrylate, ethylenediamineacrylic acid amide.

Further, in order to improve the elasticity and adhesion of the support, the above electron beam curing composition may be mixed with a thermoplastic resin. Typical examples of the thermoplastic resin include:

1) cellulose derivatives such as
nitrocellulose, cellulose acetate-butyrate, ethyl cellulose, butylcellulose;

2) polyvinyl alcohol resins such as
polyvinyl alcohol, polyvinyl butyral, polyvinyl acetal;

3) polybutadiene and butadiene copolymers such as
polybutadiene, acrylonitrile-butadiene copolymer, styrenebutadiene copolymer;

4) vinyl chloride polymers such as
vinyl chloride-vinyl acetate copolymer, vinyl chlorife-vinyl acetate-maleic acid copolymer;

5) polyurethane resins;

6) unsaturated and saturated polyester resins; and 7) polyamide resins.

These thermoplastic resins may or may not be ones with acryl-denatured double bonding introduced thereinto.

The above thermoplastic resin may be used in an amount of not more than 50% by weight of the total amount of the foregoing electron beam-curable compound and electron beam-curing monomer.

Further, a solvent may be added if necessary for the purpose of adjusting the viscosity of the above composition. The solvent to be added may be arbitrarily selected without restrictions, taking into account its solubility and compatibility with the composition.

Examples of the solvent suitably usable for preparation of the composition include alcohols such as methanol, ethanol, isopropanol, butanol; ketones such as acetone, methyl-ethyl ketone, methyl-isobutyl ketone, cyclohexanone; esters such as methyl acetate, ethyl acetate, butyl acetate, ethyl butyrate; glycol ethers such as ethylene glycol-dimethyl ether, ethylene glycol-monoethyl ether, dioxane; aromatic hydrocarbons such as benzene, toluene, xylene; and aliphatic hydrocarbons such as hexane and heptane. An appropriate mixture of these solvents may also be used.

Useful examples of the inorganic white pigment to be incorporated into the resin coat layer include titanium oxide, which may be either of the anatase type or rutile type, barium sulfate, calcium carbonate, aluminum oxide, magnesium oxide, zinc oxide, silicon oxide, calcium sulfate, talc and clay. The preferred among them are titanium oxide, barium sulfate and calcium carbonate.

The pigment is added in an amount of preferably 20 to 70% by weight, more preferably 30 to 60% by weight of the foregoing resin coat layer. The average particle diameter of the pigment is preferably 0.05 to 10 μm, more preferably 0.1 to 3 μm.

To the electron beam curing composition may, if necessary, be added coloring pigments, antistatic agent, brightening agent and others.

The electron beam curing composition for coating in the invention is prepared, for example, in the following manner:

The aforementioned components are all at a time or in sequence put into a kneading machine.

For the kneading/dispersing of the coating composition any one of various kneading machines may be used which include double-roll mill, triroll mill, pebble mill, ball mill, sand grinder, high-speed stone mill, high-speed impact mill, kneader and homogenizer.

The coating of the resin layer is carried out in accordance with any one of the air doctor coating, blade coating, squeeze coating, air knife coating, reverse roll coating, transfer roll coating and cast coating methods.

The thickness of the resin layer is preferably i to 100 μm, more preferably 5 to 50 μm.

The electron beam accelerator used may be any one of the electrocurtain system, van de Graaff type scanning system and double scanning system. The accelerator, as its electron beam characteristics, should be of preferably 70 to 750 KV, more preferably 100 to 800 KV from the penetrability point of view, and of an absorption dose of from 0.1 to 10 Mrad.

The electron beam radiation should be made in an atmosphere of an inert gas such as $N_2$, He or $CO_2$ to the resin coat layer in close contact with the surface of a metallic drum.

When a paper is used as the substrate, it is preferable to laminate an electron beam-cured resin layer or a polyolefin resin layer on the back surface of the substrate opposite to the surface on which the electron beam-cured resin layer is formed. Among them, the polyolefin resin layer is more preferable, which is laminated on the back surface of the substrate by extruding molten polyolefin resin to form a resin layer. The polyolefin resin layer preferably has a thickness of 10 to 40 μm.

The photographic support thus obtained may be subjected to a surface treatment such as corona discharge treatment or may be coated with a subbing layer in order to improve its adhesion characteristic to the photographic component layer or backing layer.

The R, G and Oi of the equation in the constituent of the invention are explained.

In the above, R represents the curling degree (reciprocal of radius of curvature) in the longitudinal direction of a 82 mm×117 mm-size piece of the support before being coated with an emulsion layer, provided the curling degree is a positive number in the case of the piece with its emulsion side in. The curl measurement is conducted under atmospheric conditions of 23° C./20% RH. The curling degree is expressed in meters.

The curl control can be conducted in any methods with no restrictions; there are, for example, a method for varying the resin layer thickness ratio of the obverse to the reverse of the support during the process of its manufacture; and a mechanical means for forcibly getting the support to form a coutercurl after its manufacture.

The amount of gelatin represented by G is the coated weight of the dry gelatin in a unit area (per $m^2$) of the hydrophilic colloid layer formed on the resin coat layer containing a white pigment.

The value of G is preferably 2 to 20 $g/m^2$, and more preferably 4 to 10 $g/m^2$.

The amount of oil represented by Oi is the coated weight of the dry oil component in a unit area (per $m^2$) of the hydrophilic colloid layer formed on the resin coat layer containing a white pigment.

The value of Oi is preferably 0 to 20 $g/m^2$, and more preferably 3 to 15 $g/m^2$.

In the invention, the oil component comprises a high-boiling organic solvent, a coupler to be dissolved in the solvent, a UV absorbent and image preservative, and further include a less-soluble synthetic polymer in the form of a polymer latex or a polymer latext having a function as a coupler or of a UV absorption.

The gelatin used for the invention includes not only liming process gelatin but also acid process gelatin and the enzymatic process gelatin described in Bull. Sci. Phot. Japan, No. 16, p.30 (1966). A hydrolyzed product or enzyme-decomposed product of gelatin may also be used. Gelatin derivatives may also be used which include those obtained by the reaction of gelatin with various compounds such as an acid halide, an acid anhydride, an isocyanate, bromoacetic acid, an alkanesultone, a vinylsulfonamide, a maleic imide compound, a polyalkyleneoxide, an epoxy compound.

Examples of the high-boiling solvent include organic solvents having a boiling point of not less than 150° C. such as phenol derivatives not reactive with the oxidation product of a developing agent, alkyl phthalates, phosphates, citrates, benzoates, alkylamides, aliphatic acid esters and trimesates.

As the yellow dye forming coupler, known acylacetoanilide couplers may be suitably used. Among them benzoylacetanilide and pivaloylacetanilide compounds are advantageous.

As the magenta dye forming coupler, known 5-pyrazolone couplers, pyrazolobenzimidazole couplers, pyrazoloazole couplers and open-chain acylacetonitrile couplers can be suitably used.

As the cyan dye forming coupler, known naphthol couplers, phenol couplers and imidazole couplers can be suitably used. The advantageous among them are 2-acylamino-5-alkylphenols and 2,5-diacylaminophenols.

Useful examples of the UV absorbent include benzophenone compounds, butadiene compounds, 4-thiazolidone compounds, benzotriazole compounds, benzoxazole compounds and cinnamate compounds.

Useful examples of the image stabilizer include hydroquinone derivatives, gallic acid derivatives, phenol derivatives and their bis-compounds, hydroxycoumarane and its spiro compound, hydroxychroman and its spiro compound, piperidine derivatives, aromatic amine compounds, benzodioxane derivatives, benzodioxole derivatives, silicon atom-containing compounds and thioether compounds.

Gelatin or a gelatin derivative is used as the binder or protective colloid for the silver halide emulsion layer and non-light-sensitive layer of the silver halide photographic light-sensitive material of the invention (hereinafter also called merely 'light-sensitive material'), but other hydrophilic colloid such as a protein, a sugar derivative, a cellulose derivative or a synthetic hydrophilic homo- or copolymer material may be used in combination.

The protein is preferably albumin or casein; the cellulose derivative is preferably hydroxyethyl cellulose, carboxymethyl cellulose or cellulose sulfate; and the sugar derivative is preferably sodium alginate or starch derivatives.

Typical examples of the synthetic hydrophilic polymer include homo- or copolymer materials such as polyvinyl alcohol, polyvinyl alcohol partially acetal, poly-N-vinylpyrrolidone, polyacrylic acid, polymethacrylic acid, polyacrylamide, polyvinylimidazole and polyvinylpyrazole as described in West German OLS Patent No. 2,312,708; U.S. Pat. Nos. 3,620,751 and 3,879,205; and JP E.P. No. 7561/1968.

The binder used in the invention is preferably crosslinked with a hardener. Examples of the hardener include known hardening agents and polymer hardening agent such as aldehyde, aziridine, isooxazole, epoxy, vinylsulfone, acryloyl, carbodiimide, triazine (cyanur chloride), mucohalogenic acid, maleic imide, acetylene, methansulfonate and N-methylol compounds. These may be used alone or in combination. The preferred among these are the vinylsulfone hardening agents and s-triazine hardening agents described in JP O.P.I. No. 134367/1993.

The hardener is added in an amount of preferably 0.5 to 100 mg, more preferably 5.0 to 50 mg per gram of gelatin to be coated.

The silver halide grain used for the light-sensitive material of the invention, although not restricted, has preferably a silver chloride content of not less than 90 mol %; a silver bromide content of not more than 10 mol %; and a silver iodide content of not more than 0.5 mol %; and more preferably the silver halide is silver chlorobromide having a silver bromide content of 0.1 to 2 mol %.

The silver halide grains may be used either alone or in a mixture thereof with other silver halide grains different in the composition. Further they may be used in a mixture thereof with silver halide grains whose silver chloride content is not more than 10 mol %.

In the silver halide emulsion layer containing silver halide grains having a silver chloride content of not less than 90 mol %, the silver halide grains having a silsver chloride content of not less than 90 mol % account for preferably not less than 60% by weight, more preferably not less than 80% by weight of the whole silver halide grains contained in the emulsion layer.

The silver halide grain may be either uniform in the composition throughout the grain or not uniform with difference in the composition between the inside and the outside thereof. Where the inside and the outside of the grain are different in the composition, the composition may change continuously or discontinuously.

The grain diameter of the silver halide grain used in the invention, although not restricted, is preferably 0.2 to 1.6 μm, more preferably 0.25 to 1.2 μm when taking into account the adaptability to rapid processing, sensitivity and other photographic characteristics. The above grain diameter can be determined according to various measuring methods generally known to those skilled in the art, of which typical methods are found in Loveland, 'Grain Diameter Analysis Methods' (A.S. T.M. Symposium on Light Microscopy, 1955, pp.94–122) or Meese & James, 'The Theory of Photographic Process,' 3rd ed., MacMillan (1966).

The grain diameter can be measured by using the projection area of or an approximate value of the grain. Where grains are substantially in a uniform shape, the grain size distribution can be fairly accurately expressed with their diameters or projection areas.

The silver halide used in the invention may be of either polydisperse-type or monodisperse-type grain diameter distribution, preferably monodisperse silver halide grains which, in the grain diameter distribution thereof, have a variation coefficient of not more than 22, and more preferably not more than 0.15, wherein the variation coefficient is a coefficient representing the broadness of the grain diameter distribution and defined by:

$$\text{Variation coefficient} = \frac{\text{Standard deviation of grain diameter distribution}}{\text{Average grain diameter}}$$

wherein the grain diameter, in the case of a spherical silver halide grain, is its diameter, while, in the case of a cubic or nonspherical grain, is the diameter of a circular image equivalent in the area to its projection image.

The silver halide grains of the emulsion of the invention may be prepared according to any one of acidic, neutral and ammoniacal methods. The grains may be grown at a time or may, after preparing seed grains, be grown therefrom. The method for preparing seed grains and the method for growing grains may be the same or different.

The reaction of an aqueous silver salt solution and an aqueous halide solution may be carried out by any of normal precipitation method, reverse precipitation method, double-jet precipitation method or a combination of these methods, but preferably by the double-jet precipitation method. As one form of the double-jet precipitation method, the pAg-controlled double-jet method described in JP O.P.I. No.48521/1979 may also be used. If necessary, a silver halide solvent such as thioether may be used. A compound such as a mercapto group-containing compound, a nitrogen-containing heterocyclic compound or a sensitizing dye may be added during or after the formation of silver halide grains.

The silver halide grain form is discretional. A suitable example of the grain form is a cube having {100} faces as crystal planes. Octahedral, tetradecahedral or dodecahedral crystal grains may also be used which can be prepared according to the appropriate methods described in U.S. Pat. Nos. 4,183,756 and 4,225,666; JP O.P.I. No. 26589/1980; JP E.P. No. 42737/1980; and J. Photgr. Sci., vol.21, p.39 (1973). Further, twin crystal planes-having grains may also be used. The silver halide grains used may be either single crystal grains or a mixture of various grains having different crystal forms.

The silver halide grain may contain metallic ions in the inside and/or the surface thereof by adding thereto a cadmium salt, a zinc salt, a lead salt, a thalium salt, an iridium salt including a complex salt thereof, a rhodium salt including a complex salt thereof or an iron salt including a complex salt thereof during the grain forming and/or growing process, and also may have a reduction sensitization speck provided to the inside and/or the surface thereof by placing the grain in an appropriate reductive atmosphere.

The silver halide is spectrally sensitized by use of sensitizing dyes already known to those skilled in the art. Particularly useful dyes are cyanine dyes, merocyanine dyes and complex merocyanine dyes.

To these dyes may be applied any of nuclei normally utilized as basic heterocyclic nuclei to cyanine dyes, such as pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, nuclei formed by the fusion of an alicyclic hydrocarbon ring with these nuclei, and nuclei formed by the fusion of an aromatic hydrocarbon ring, such as indolenine nucleus, benzoindolenine nucleus, indole nucleus, banzoxazole nucleus, naphthoxozole nucleus, benzothiazole nucleus, naphthothiazole nucleus, benzoselenazole nucleus, benzimidazole nucleus and quinoline nucleus. These nuclei may have a substituent on a carbon atom thereof.

To the merocyanine dye or complex merocyanine dye may be applied as ketomethylene structure-having nuclei 5- to 6-member heterocyclic nuclei such as pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

The addition of sensitizing dyes can be made by methods well known to those skilled in the art; for example, a sensitizing dye can be added in the form of a solution by being dissolved in a water-soluble solvent such as pyridine, methyl alcohol, ethyl alcohol, methyl cellosolve, acetone or a mixture of such solvents, or diluted with water or dissolved in water when occasion demands, to thereby prepare its solution. It is advantageous for the dissolving of sensitizing dyes to utilize ultrasonic oscillation. The addition of sensitizing dyes used in the invention may be carried out in several ways: A sensitizing dye, as described in U.S. Pat. No. 3,469,987, is dissolved in a volatile organic solvent, the solution is dispersed in a hydrophilic colloid, and the dispersion is added to the emulsion; as described in JP E.P. No.34185/1971, a water-insoluble sensitizing dye is directly dispersed in a water-soluble solvent and the dispersion is added to the emulsion; a sensitizing dye is added in the form of a dispersion according to an acid solution/dispersion method; and other adding methods as described in U.S. Pat. Nos. 2,912,345, 3,342,605, 2,996,287 and 3,425,835.

Sensitizing dyes to be incorporated into the silver halide emulsion may be dissolved separately in some parts of the same solvent or in different solvents, and these solvent solutions of the dyes may be either mixed before being added to or separately added to the silver halide emulsion. When separately added, the adding order, adding periods of time and time intervals can be discretionally determined according to purposes. The addition of the dye to the emulsion can be made at any point of time in the preparation process of the emulsion, but preferably during or after, more preferably during the chemical ripening stage in the preparation process of the emulsion.

Together with the above-mentioned sensitizing dyes there may be used a dye which in itself has no spectral sensitization effect or a substance which does substantially not absorb visible rays but shows a supersensitization effect, examples of which include aromatic oranic acid-formaldehyde condensates as described in U.S. Pat. No. 3,437,510; and cadmium salts, azaindene compounds, and nitrogen-containing heterocyclic group-substituted aminostilbene compounds as described in U.S. Pat. Nos. 2,933,390 and 3,635,721. The combinations of such compounds described in U.S. Pat. Nos. 3,615,613, 3,615,641, 3,617,295 and 3,635,721 are particularly useful.

In addition to the above compounds, various other photographic additives may be added to the light-sensitive material of the invention. There are, for example, development accelerators such as 1-allyl-3-pyrazolidone compounds; surface active agents such as alkylnaphthalenesulfonates, alkylsuccinatesulfonates, itaconates, polyalkylene-oxide compounds; water-soluble antiirradiation dyes such as azo, styryl, oxonol, anthraquinone and triphenylmethane compounds; emulsion physical property improving agents such as glycerol, polyalkylene glycol, polymer latexes, solid or liquid paraffin; anti-color-crossover agents such as nondiffusible hydroquinone compounds; and water-soluble or oil-soluble brightening agents; and background tinting agents such as oil-soluble coloring dyes.

Among the additives which need not be adsorbed onto the surface of the silver halide crystal grain such as dye-forming couplers, colored couplers, DIR couplers, DIR compounds, image stabilizers, antifoggants, UV absorbing agents and brightening agents, the hydrophobic additives may be added in accordance with various methods such as a solid dispersion method, a latex dispersion method, an oil-in-water emulsion dispersion method, and the like, which may be arbitrarily selected according to the chemical structure or other characteristics of the hydrophobic compound to be used such as a coupler. The oil-in-water emulsion dispersion method for use in dispersing a hydrophobic additive such as a coupler is usually such that the hydrophobic compound is dissolved in a high-boiling organic solvent having a boiling point of about 150° C. or above, if necessary, in combination with a low-boiling and/or water-soluble organic solvent, and this solution is emulsifiedly dispersed into a hydrophilic binder such as an aqueous gelatin solution with a surface active agent by using a dispersing means such as a stirrer, homognizer, colloid mill, flow-jet mixer or ultrasonic device, and then the prepared dispersion is added to an objective hydrophilic colloid layer. This method may include a process for removing the dispersion fluid or removing the low-boiling organic solvent simultaneously with the dispersing.

The high-boiling organic solvent:low-boiling organic solvent ratio is preferably in the range of 1:0.1 to 1:50, more preferably 1:1 to 1:20.

As an assistant for dispersing the above additives a surface active agent may be used; examples of it include anionic surfactants such as alkylbenzenesulfonates, alkylnaphthalenesulfonates, alkyl sulfates, alkyl phosphates, sulfosuccinates, sulfoalkylpolyoxyethylenealkylphenyl ethers; nonionic surfactants such as steroid saponin, alkylene-oxide derivatives, glycidyl derivatives; amphoteric surfactants such as amino acids, aminoalkylsulfonates and alkylbetaines; and cationic surfactants such as quaternary ammonium salts. Concrete examples of these surface active agents are described in the 'Kaimenkasseizai Benran' (handbook of surface active agents) (Sangyo-Tosho, 1966), and the 'Nyukazai, Nyuka-Sochi Kenkyu Gijutsu Deita Shu' (collection of studies and technical data on emulsifying agents and emulsifying equipment) (Kagaku-Hanron Co., 1978).

As the latex dispersion method it is suitable to use those methods as described in U.S. Pat. Nos. 4,199,363, 4,214,047, 4,209,716 and 4,247,627; and JP O.P.I. Nos. 74538/1974, 59942/1976, 59943/1976 and 32552/1979.

The light-sensitive material of the invention, after being exposed imagewise, can form an image by being processed in a color developer solution according to the method well-known to those skilled in the art.

The color developing agent used in the color developer solution includes known compounds widely used in various photographic processes. These developing agents include aminophenol and p-phenylenediaming derivatives. These compounds are used in the form of salts such as hydrochlorides or sulfates so as to be more stable than in the free state. The developing agent is used normally in a concentration of about 0.1 to 30 g, preferably about 1 to 15 g per liter of a color developer solution.

The color developing agent is typified by aromatic primary amine compounds, particularly p-phenylenediamine compounds, suitable examples of which include N,N-diethyl-p-phenylenediamine hydrochloride, N-ethyl-p-phenylenediamine hydrochloride, N,N-dimethyl-p-phenylenediamine hydrochloride, 2-amino-5 -(N-ethyl-N-dodecylamino)-toluene, N-ethyl-N-(β-methanesulfonamido-ethyl)-3 -methyl-4-aminoaniline sulfate, N-ethyl-N-β-hydroxyethylaminoaniline, 4-amino-N-(2-methoxyethyl)-N-ethyl-3 -methyl-aniline-p-toluenesulfonate, N,N-diethyl-3-methyl-4-aminoaniline and N-ethyl-N-(β-hydroxyethyl)-3-methyl-4-aminoaniline.

These color developing agents may be used alone or in combination of two or more kinds thereof or in combination of one or two or more thereof with other black-and-white developing agents such as hydroquinone, 1-phenyl-3-pyrazolidone, N-methyl-p-aminophenols and the like.

When the light-sensitive material of the invention is processed in a color developer solution, the most useful color developing agent among the above compounds is N-ethyl-N-(β -methanesulfonamidoethyl)-3-methyl-4-aminoaniline sulfate.

Besides the above color developing agent, the color developer solution may, at need, contain other photographic additives including an alkali agent such as sodium hydroxide, potassium hydroxide, sodium carbonate, sodium tertiary phosphate, potassium carbonate or potassium hydrogencarbonate; a preservative such as N,N-diethylhydroxylamine, N,N-bis(methoxyethyl)hydroxylamine, triethanolamine, diethanolamine glycol or potassium sulfite; an organic solvent such as methanol, ethanol, butanol, ethylene glycol or diethylene glycol; a development adjusting agent such as citrasic acid, polyethylene glycol; a heavy metal ion hiding agent, a development accelerator, and the like.

Where the color developer solution contains benzyl alcohol as a color-formation improving agent, sulfite ions such as sodium sulfite or potassium sulfite as its preservative, even when added in a relatively large amount such as about 0.01 mol or more per liter of the color developer solution, little lowers the color formability, but in the case where the benzyl alcohol content of the color developer solution is zero up to about 5 ml/liter at the most, the sulfite ion concentration needs to be reduced to not more than about 0.004 mol/liter of the color developer solution.

The light-sensitive material of the invention is preferably developed in a color developer solution containing little or no water-soluble bromide at all. The bromide ion concentration in the color developer solution, in potassium bromide equivalent, is preferably approximately not more than 0.1 g, more preferably not more than 0.05 g per liter of the color developer solution.

When the light-sensitive material of the invention is continuously processed in a color developer solution while being replenished continuously, if the bromide ion continues to be slightly eluted from the light-sensitive material as a result of the development, the slightly eluted bromide ion becomes accumulated in time in the developer solution, but even in this instance, it is preferable to control the bromide ion content of the color developer solution so as to come in the above range by appropriately selecting the replenishing ratio of the color developer replenisher solution to the whole amount of the bromide contained in the light-sensitive material.

The effect of the invention becomes very significant when a water-soluble chloride is used as a development adjusting agent in the above color developer solution. The water-soluble chloride is used in the amount range of 0.5 to 5 g, preferably 1 to 3 g per liter of the color developer solution, calculated in terms of potassium chloride.

In the color developer solution, the organic development accelerator described in JP O.P.I. No. 95345/1983 can be used. Preferably an adenine or guanine is used in an amount of 0 to 0.02 g per liter of the color developer solution.

The developer solution is used preferably at pH of 9.5 to 13. It is well-known that to raise pH of a developer solution is to accelerate its development. However, the light-sensitive material comprising a silver halide emulsion having a silver chloride content of 90 mol %; or more shows a sufficient adaptability to rapid processing even in a developer solution with pH of not more than 11.

The processing temperature in the color developer solution is preferably 15° to 45° C., more preferably 20° to 40° C.

The light-sensitive material, after its color development, is subjected to bleaching and fixing treatments. The bleaching treatment may be conducted simultaneously with the fixing treatment. As the bleaching agent there are many compounds to be used; especially, multivalent metallic compounds such as of iron (III), cobalt (III) and copper (II). Among others, complex salts of these multivalent metallic cations with organic acids, which include, e.g., metallic complex salts of aminopolycarboxylic acids such as ethylenediaminetetraacetic acid, nitrilotriacetic acid and N-hydroxyethylethylenediaminediacetic acid; malonic acid, tartaric acid, malic acid, diglycolic acid and dithioglycolic acid; or ferricyanates and bichromates may be used alone or in combination.

As the fixing agent there may be used a water-soluble complexing agent that makes silver halide soluble in the form of a complex salt. Examples of the water-soluble complexing agent include sodium thiosulfate, ammonium thiosulfate, potassium thiocyanate, thiourea and thioether.

After completion of the fixing process, the light-sensitive material is usually washed. The washing process may be replaced by stabilization process, or both may be used in combination. The stabilizing solution used for the stabilization process may contain a pH adjusting agent, a chelating agent, an antimold agent and the like. For the adding conditions of these additives reference can be made to JP O.P.I. No. 134636/1983.

EXAMPLES

Examples of the invention are illustrated below, but the invention is not restricted by the examples.

Preparation of Support 1

On one side of a paper substrate having an weight of 175 g/m$^2$ was formed a polyethylene backing laminate layer of 30 g/m$^2$ in weight by an extrusion laminating process, whereby a paper support sheet was prepared.

Next, the following white pigment-containing electron beam-curing composition was prepared.

Electron beam-curing composition

| | |
|---|---|
| Epoxyacrylate (NK Ester EA800, produced by Shinnakamura Chemical Co.) | 20 parts by wt |
| Polybutadiene (TEA-1000, produced by Nippon Soda Co.) | 15 parts by wt |
| Triethylene glycol diacrylate | 20 parts by wt |
| Titanium dioxide (anatase type, average diameter: 0.2 μm) | 45 parts by wt |

The above mixture was dispersed for 20 minutes by means of a ball mill. The obtained composition was-coated on the non-backing-laminate-layer side of the substrate by use of a wire bar so as to have a cured weight of 25 g/m$^2$. This coated layer was cured by being subjected to electron beam radiation under conditions of an acceleration voltage of 165 kV and an absorption dose of 2 Mrad, whereby a cured resin-coat layer-having Support 1 was obtained.

On the cured resin coat layer of Support 1 were coated the following layers, whereby a multilayer silver halide light-sensitive material sample was prepared. The coating solutions were prepared as follows.

Layer 1 coating solution

Twenty-six point seven grams of yellow coupler Y-1, 10.0 g of dye image stabilizer ST-1 and 6.67 g of ST-2 were dissolved by adding 60 ml of ethyl acetate thereto, and this solution was emulsifiedly dispersed into 220 ml of an aqueous 10% gelatin solution containing 7 ml of 20% surfactant SU-1 by using a ultrasonic homogenizer, whereby a yellow coupler dispersion was prepared.

This dispersion was mixed with a blue-sensitive silver halide emulsion containing 10 g of silver to thereby prepare Layer 1 coating solution.

Coating solutions for Layers 2 to 7 were prepared each in a manner similar to that in Layer 1.

Hardening agent H-1 was added in amounts of 40 mg/m$^2$, 50 mg/m$^2$ and 60 mg/m$^2$ to Layers 2, 4 and 7, respectively. A surfactant SU-2 was added as coating aids to adjust the surface tension, and further 0.2M nitric acid was used to adjust pH of the coating solution so as to make the surface pH 5.85.

| Layer | Component | Adding amt ($g/m^2$) |
|---|---|---|
| Lasyer 7 (Protective layer) | Gelatin | 1.00 |
| | Antistain agent HQ-2 | 0.002 |
| | Antistain agent HQ-3 | 0.002 |
| | Antistain agent HQ-4 | 0.004 |
| | Antistain agent HQ-5 | 0.02 |
| | DIDP (high-boiling organic solvent) | 0.005 |
| | Compound F-1 | 0.002 |
| Layer 6 (UV absorbing layer) | Gelatin | 0.40 |
| | UV absorbent UV-1 | 0.10 |
| | UV absorbent UV-2 | 0.04 |
| | UV absorbent UV-3 | 0.16 |
| | Antistain agent HQ-5 | 0.04 |
| | DNP (high-boiling organic solvent) | 0.20 |
| | PVP | 0.03 |
| | Antiirradiation dye AI-2 | 0.02 |
| | Antiirradiation dye-AI-4 | 0.01 |
| Layer 5 (Red-sensitive layer) | Gelatin | 1.30 |
| | Red-sensitive silver chlorobromide emulsion Em-R | 0.21 |
| | Cyan coupler C-1 | 0.17 |
| | Cyan coupler C-2 | 0.25 |
| | Dye image stabilizer ST-1 | 0.20 |
| | Antistain agent HQ-1 | 0.01 |
| | HBS-1 (high-boiling organic solvent) | 0.20 |
| | POP (high-boiling organic solvent) | 0.20 |
| Layer 4 (UV absorbing layer) | Gelatin | 0.94 |
| | UV absorbent UV-1 | 0.28 |
| | UV absorbent UV-2 | 0.09 |
| | UV absorbent UV-3 | 0.38 |
| | Antistain agent HQ-5 | 0.10 |
| | DNP (high-boiling organic solvent) | 0.40 |
| Layer 3 (Green-sensitive layer) | Gelatin | 1.40 |
| | Green-sensitive silver chlorobromide emulsion Em-G | 0.17 |
| | Magenta coupler M-1 | 0.23 |
| | Dye image stabilizer ST-3 | 0.20 |
| | Dye image stabilizer ST-4 | 0.17 |
| | DIDP (high-boiling organic solvent) | 0.13 |
| | DBP (high-boiling organic solvent) | 0.13 |
| | Antiirradiation dye AI-1 | 0.01 |
| Layer 2 (Interlayer) | Gelatin | 1.20 |
| | Antistain agent HQ-2 | 0.03 |
| | Antistain agent HQ-3 | 0.03 |
| | Antistain agent HQ-4 | 0.05 |
| | Antistain agent HQ-5 | 0.23 |
| | DIDP (high-boiling organic solvent) | 0.06 |
| | Compound F-1 | 0.002 |
| Layer 1 (Blue-sensitive layer) | Gelatin | 1.20 |
| | Blue-sensitive silver chlorobromide emulsion Em-B | 0.26 |
| | Yellow coupler Y-1 | 0.80 |
| | Dye image stabilizer ST-1 | 0.30 |
| | Dye image stabilizer ST-2 | 0.20 |
| | Antistain agent HQ-1 | 0.02 |
| | Antiirradiation agent AI-3 | 0.01 |
| | DNP (high-boiling organic solvent) | 0.20 |
| Support | The above-mentioned Support 1 | |

The adding amount of each silver halide emulsion is in silver equivalent.

Preparation of blue-sensitive silver chlorobromide emulsion

To 1000 ml of an aqueous 2% gelatin solution kept at 40° C. were added spending 30 minutes the following Solutions A and B simultaneously with pAg and pH being controlled to 6.5 and 3.0, respectively, and then further added spending 180 minutes the following Solutions C and D simultaneously with pAg and pH being controlled to 7.3 and 5.5, respectively. In this instance, the pAg control was made according to the method described in JP O.P.I. No. 45437/1984, while the pH control was made by use of sulfuric acid or an aqueous sodium hydroxide solution.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| Potassium bromide | 1.0 g |
| Water to make | 600 ml |
| Solution D | |
| Silver nitrate | 300 g |
| Water to make | 600 ml |

After completion of the addition, the emulsion was desalted by use of an aqueous 5% solution of Demol N, produced by Kao Atlas Co., and an aqueous 20% magnesium sulfate solution, and then mixed with an aqueous gelatin solution, whereby a monodisperse cubic grains emulsion EMP-1 having an average grain diameter of 0.85 μm, a variation coefficient of 0.07 and a silver chloride content of 99.5 mol % was obtained.

The above emulsion EMP-1 was chemically ripened for 90 minutes at 50° C. with use of the following compounds, whereby a blue-sensitive silver chlorobromide emulsion Em-B was obtained.

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of green-sensitive silver chlorobromide emulsion

A monodisperse cubic grains emulsion EMP-2 having an average grain diameter of 0.43 μm, a variation coefficient of 0.08 and a silver chloride content of 99.5 mol % was obtained in the same manner as in EMP-1 except that the adding time of Solutions A and B and the adding time of Solutions C and D were changed.

The above emulsion EMP-2 was chemically ripened for 120 minutes at 55° C. with use of the following compounds to thereby obtain a green-sensitive silver chlorobromide emulsion Em-G.

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizing dye GS-1 | $4 \times 10^{-4}$ mol/mol AgX |

Preparation of red-sensitive silver chlorobromide emulsion

A monodisperse cubic grains emulsion EMP-3 having an average grain diameter of 0.50 μm, a variation coefficient of 0.08 and a silver chloride content of 99.5 mol % was obtained in the same manner as in EMP-1 except that the adding time of Solutions A and B and the adding time of Solutions C and D were changed.

The above emulsion EMP-3 was chemically ripened for 90 minutes at 60° C. with use of the following compounds, whereby a red-sensitive silver chlorobromide emulsion Em-R was obtained.

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizing dye BS-1 | $1 \times 10^{-4}$ mol/mol AgX |

STAB-1: 4-hydroxy-6-methyl-1,3,3a,7-tetrazaindene
SU-1: sodium tri-i-propylbenzenesulfonate
SU-2: Sodium sulfosuccinate-di-(2-ethylhexyl)
H-1: sodium 2,4-dichloro-6-hydroxy-s-triazine
DBP: Butyl phthalate
DOP: Dioctyl phthalate
DNP: Dinonyl phthalate
DIDP: di-i-decyl phthalate
HBS-1: 4-(p-dodecylphenyl)sulfamoyltoluene
PVP: polyvinyl pyrrolidone
HQ-1: 2,5-di-t-octylhydroquinone
HQ-2: 2,5-di-s-dodecylhydroquinone
HQ-3: 2,5-di-s-tetradecylhydroquinone
HQ-4: 2-s-dodecyl-5-s-tetradecylhydroquinone
HQ-5: 2,5-di(1,1-dimethyl-4-hexyloxycarbonyl)butylhydroquinone

Y-1

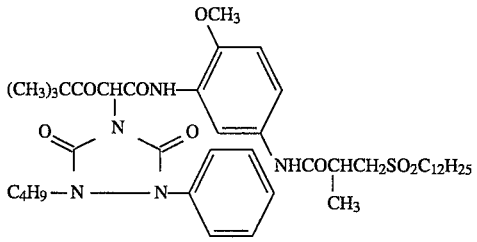

M-1

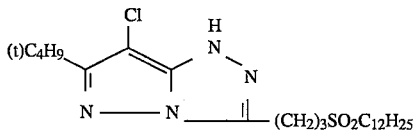

C-1

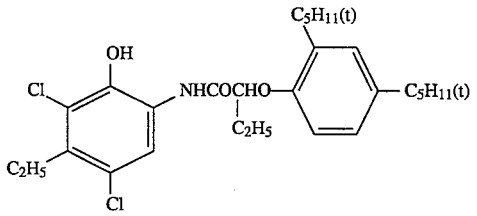

C-2

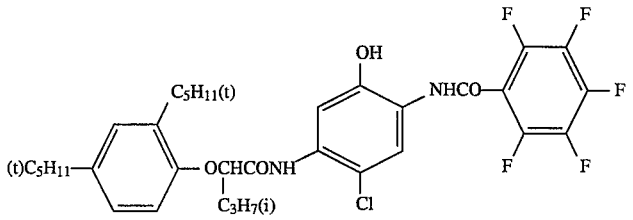

ST-1

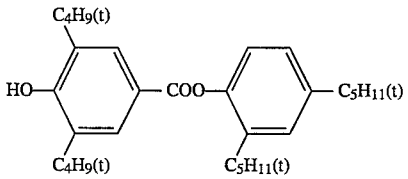

ST-2

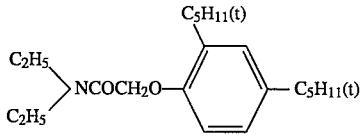

ST-3

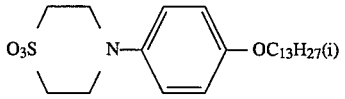

-continued
ST-4
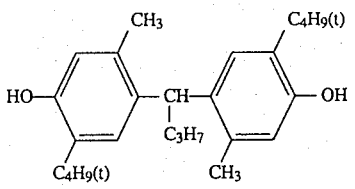
A mixture of
F-1
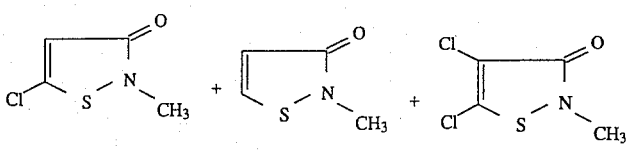
molar ratio of 50:46:4
UV-1
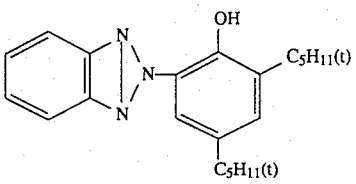
UV-2
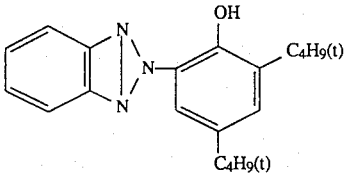
UV-3
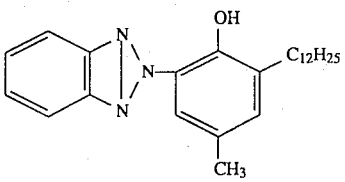
AI-1
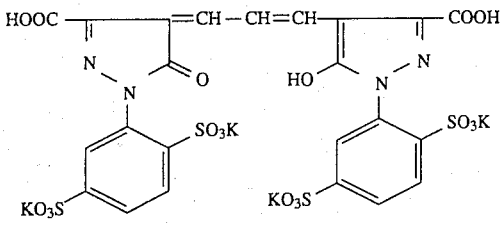
AI-2
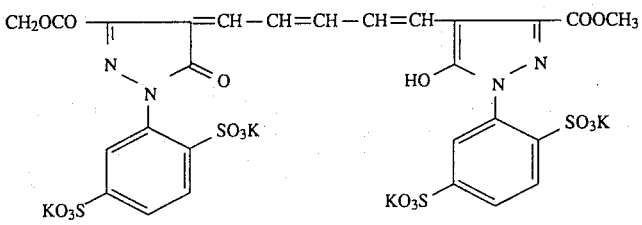
AI-3
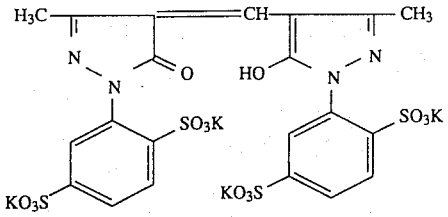
AI-4
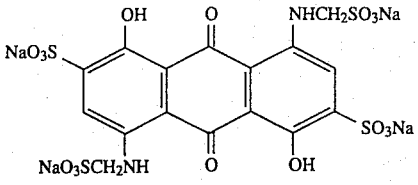

Preparation of Supports 2, 3 and 4

Support samples were prepared in the same manner as in Support 1 except that the amount of titanium dioxide used in Support 1 was changed to 10, 20, 30, 60 and 65 parts by weight, and the total amount of the other materials with their proportion fixed was changed so as to make the whole 100 parts by weight, and the prepared support samples were designated as Supports 2, 3, 4, 5 and 6. An attempt was made to prepare a support sample with titanium dioxide in 75 parts by weight, but its resin coat layer's surface smoothness was found inferior, so further experiments were discontinued.

Support samples 2, 3 and 4 each were wound around various cores different in the radius with heating to obtain desired curling degrees. The obtained curl degrees are shown in Table 1.

Measurement of curling degree

The support sample was cut into a 82 mm×117 mm size piece, the piece was conditioned for 24 hours to atmosphere at 23° C./20% RH, and then, in the same atmosphere, the curling degree in the longitudinal direction (reciprocal of radius of curvature) was measured, provided the measured value is to be positive (+) if the piece is with its emulsion coating side in.

One side surface of each support thus obtained was subjected to corona discharge treatment with an intensity of 20 W/m$^2$.min, and on the surface was coated in sequence the following photographic component layers, and then dried, whereby color photographic paper samples were prepared.

The amount of gelatin and the amounts of the oil components (high-boiling organic solvent, image stabilizer, UV absorbent) in the following photographic layers were varied as shown in Table 1, wherein the oil components ratio was made constant.

Each color photographic paper sample was processed in an automatic processor under the following conditions, and its tansportability was evaluated. The results are also shown in Table 1.

Transportability

Imagewise exposed 1000 sheets of each color photographic paper sample were processed in the usual print-making manner in an automatic processor Minilab QSS1501, manufactured by Nohritsu Co., which was placed under ambient conditions of 23° C./10% RH, and the frequency in percentage of transport trouble that occurs between the printer section and the processor section of the processor was examined for evaluation. The criteria for the evaluation are as follows:

TABLE 1

A: No trouble at all
B: Trouble occurrence frequency: 0 to 0.2%
C: Trouble occurrence frequency: 0.2 to 0.5%
D: Trouble occurrence frequency: 0.5 to 1.0%
E: Trouble occurrence frequency: 1% or morein

| Sample No. | Support: Pigment content | Support: Curling deg. R (l/m) | Emulsion: G (g/m$^2$) | Emulsion: Oi (g/m$^2$) | Y value | Transportability |
|---|---|---|---|---|---|---|
| 1 (Comp.) | 10 | −4 | 7.4 | 10.4 | −1.5 | D |
| 2 (Inv.) | 20 | −4 | 7.4 | 10.4 | −1.5 | B |
| 3 (Inv.) | 30 | −4 | 7.4 | 10.4 | −1.5 | A |
| 4 (Inv.) | 45 | −4 | 7.4 | 10.4 | −1.5 | A |
| 5 (Inv.) | 45 | −1 | 10.5 | 10.4 | 4.3 | A |
| 6 (Inv.) | 45 | −4 | 10.5 | 10.4 | 1.3 | A |
| 7 (Inv.) | 45 | −8 | 10.5 | 10.4 | −2.7 | A |
| 8 (Inv.) | 45 | −1 | 7.4 | 10.4 | 1.5 | A |
| 9 (Comp.) | 45 | −8 | 7.4 | 10.4 | −5.5 | E |
| 10 (Inv.) | 45 | −1 | 5.0 | 10.4 | −0.7 | A |
| 11 (Comp.) | 45 | −4 | 5.0 | 10.4 | −3.7 | D |
| 12 (Comp.) | 45 | −8 | 5.0 | 10.4 | −7.7 | E |
| 13 (Comp.) | 45 | −1 | 10.5 | 7.0 | 5.7 | D |
| 14 (Inv.) | 45 | −4 | 10.5 | 7.0 | 2.7 | A |
| 15 (Inv.) | 45 | −8 | 10.5 | 7.0 | −1.4 | A |
| 16 (Inv.) | 45 | −1 | 7.4 | 7.0 | 2.9 | A |
| 17 (Inv.) | 45 | −4 | 7.4 | 7.0 | −0.1 | A |
| 18 (Comp.) | 45 | −8 | 7.4 | 7.0 | −4.1 | D |
| 19 (Inv.) | 45 | −1 | 5.0 | 7.0 | 0.7 | A |
| 20 (Inv.) | 45 | −4 | 5.0 | 7.0 | −2.3 | A |
| 21 (Comp.) | 45 | −8 | 5.0 | 7.0 | −6.3 | E |
| 22 (Comp.) | 45 | −1 | 10.5 | 5.0 | 6.5 | D |
| 23 (Inv.) | 45 | −4 | 10.5 | 5.0 | 3.5 | A |
| 24 (Inv.) | 45 | −8 | 10.5 | 5.0 | −0.6 | A |
| 25 (Inv.) | 45 | −1 | 7.4 | 5.0 | 3.7 | A |
| 26 (Inv.) | 45 | −4 | 7.4 | 5.0 | 0.7 | A |
| 27 (Comp.) | 45 | −8 | 7.4 | 5.0 | −3.3 | D |
| 28 (Inv.) | 45 | −1 | 5.0 | 5.0 | 1.5 | A |
| 29 (Inv.) | 45 | −4 | 5.0 | 5.0 | −1.5 | A |
| 30 (Comp.) | 45 | −8 | 5.0 | 5.0 | −5.5 | E |
| 31 (Inv.) | 60 | −4 | 7.4 | 10.4 | −1.5 | A |
| 32 (Inv.) | 65 | −4 | 7.4 | 10.4 | −1.5 | B |

What is claimed is:

1. A silver halide photographic light-sensitive material comprising a support comprising a substrate and an electron beam-cured resin layer provided on a surface of said substrate which comprises an electron beam-curable composition cured by electron beam radiation and a white pigment in an amount of 30% to 60% by weight, and a hydrophilic colloid layer provided on said resin layer which includes a silver halide emulsion layer and optionally a non-light-sensitive hydrophilic colloid layer, and contains gelatin and an oil component, wherein a curling degree of said support R m$^{-1}$, the coating amount of the gelatin contained in said hydrophilic layer G g/m$^2$, and the coating amount of the oil component contained in said hydrophilic layer Oi g/m$^2$ are each $-8 \leqq R \leqq -1$, $2 \leqq G20$ and $3 \leqq Oi \leqq 15$ ,respectively, and a value Y calculated by the following equation is $-3 \leqq Y \leqq 5$;

$$Y=0.9G-0.40i+R$$

wherein R is a curling degree in longitudinal direction of a specimen of the support, cut and slit into a 82 mm×117 mm size, at 23° C., 20% RH, and the value is positive when the specimen curls so that the side of the specimen, on which said hydrophilic layer is to be provided, is concave.

2. The material of claim 1, wherein said substrate is paper.

3. The material of claim 2, wherein said paper substrate has a polyolefin resin layer on the side opposite to the surface on which said electron beam-cured resin layer to be provided.

4. The material of claim 1, wherein the value of G is $4 \leqq G \leqq 10$ in $g/m^2$.

5. The material of claim 1, wherein the value of G is $4 \leqq G \leqq 10$ $g/m^2$; and the substrate is paper.

6. The material of claim 5, wherein said paper substrate has a polyolefin resin layer on the side opposite to the surface on which said electron beam-cured resin layer to be provided.

* * * * *